US005516036A

United States Patent [19]

Maultasch et al.

[11] Patent Number: 5,516,036

[45] Date of Patent: May 14, 1996

[54] COMBINATION LID SUPPORT AND CLOSURE DEVICE

[76] Inventors: Jonathan Maultasch, 10 Dunster Rd., Great Neck, N.Y. 11021; Bruce Maultasch, 252 Forest Dr., Jericho, N.Y. 11753

[21] Appl. No.: 491,488

[22] Filed: Jun. 16, 1995

[51] Int. Cl.[6] ..... B65D 5/50

[52] U.S. Cl. ..... 229/125.39; 229/199; 229/906; 426/115

[58] Field of Search ..... 229/125.37, 125.39, 229/125.41, 199, 902, 906; 426/110, 115; 206/521, 525, 541

[56] References Cited

U.S. PATENT DOCUMENTS

| | | | |
|---|---|---|---|
| 923,111 | 5/1909 | Boberg . | |
| 1,689,069 | 10/1928 | Carver et al. | 229/125.39 |
| 1,760,106 | 5/1930 | Beach . | |
| 1,761,787 | 6/1930 | Gorman, Jr. | 229/125.39 |
| 1,774,299 | 8/1930 | Stubbs et al. . | |
| 1,821,307 | 9/1931 | Howland | 229/199 |
| 2,238,468 | 4/1941 | Hayden . | |
| 2,562,261 | 7/1951 | Collins . | |
| 2,852,133 | 9/1958 | Bonini et al. | 229/125.39 |
| 2,987,237 | 6/1961 | Bemiss et al. . | |
| 3,027,063 | 3/1962 | Zastrow . | |
| 3,043,068 | 7/1962 | Blonder . | |
| 3,252,650 | 5/1966 | Pryor . | |
| 3,545,801 | 12/1970 | Barsness | 229/125.39 |
| 3,627,541 | 12/1971 | Farquhar . | |
| 4,498,586 | 2/1985 | Vitalis | 206/541 |
| 4,556,167 | 12/1985 | Fox et al. | 229/125.39 |
| 4,700,843 | 10/1987 | Cohen | 229/906 |
| 4,877,609 | 10/1989 | Beck et al. | 229/906 |
| 4,917,291 | 4/1990 | Saiki et al. . | |
| 5,002,221 | 3/1991 | Ragan . | |
| 5,077,050 | 12/1991 | Wall | 426/115 |
| 5,305,951 | 4/1994 | Kuhn et al. . | |
| 5,366,144 | 11/1994 | Eisman | 229/199 |

*Primary Examiner*—Gary E. Elkins
*Attorney, Agent, or Firm*—Howson and Howson

[57] ABSTRACT

A device for use with a receptacle for transporting pizza. The device supports a lid of the receptacle a predetermined distance above the contained pizza and retains closed the lid of the receptacle until open by the consumer.

13 Claims, 4 Drawing Sheets

COMBINATION LID SUPPORT AND CLOSURE DEVICE

FIELD OF THE INVENTION

The present invention relates to receptacles for use in transporting prepared food products, and more particularly the present invention relates to a device for use with a pizza box to support a plurality of top lid panels for preventing them from contacting pizza contained in the box and for retaining the lid panels in a closed position during handling and transport.

BACKGROUND OF THE INVENTION

It has become a common practice for consumers to purchase food products fully prepared and to transport the food products to their residences, offices, or other consumption locations. Alternatively, the fast food industry itself has made it commonplace for the fully prepared food to be delivered directly to the customer. Such practices necessitate the use of receptacles for transporting the food products in an undisturbed state and as close as possible to its as-prepared temperature.

A cardboard box is normally used for containing pizza. The shape of the pizza requires the box to have top and bottom panels separated by peripheral sidewalls, the height of the sidewalls being quite small in relation to the dimensions of the top and bottom panels but sufficiently high as to accommodate the thickness of a pizza with some head-space above it.

Known boxes may include a single unitary lid like that illustrated in U.S. Pat. No. 5,002,221 issued to Ragan, or a plurality of segments forming the top lid such as U.S. Pat. No. 2,562,261 issued to Collins, U.S. Pat. No. 3,252,650 issued to Pryor, and U.S. Pat. No. 5,305,951 issued to Kuhn, et al. A box which is constructed in a shape other than rectangular is shown in FIG. 7 of the present application.

A particular problem with a pizza box constructed with a plurality of lid segments such as that shown in the Collins, Pryor and Kuhn patents noted above, is that they must have means for retaining the lid segments in a closed position. The above stated box structures utilize various flap configurations to join the segments in a closed position.

The shallow shapes of the various pizza boxes have an inherent problem in that the center of the top lid, or top lid segments, may bow downward and contact the top of the contained pizza. The heat of the pizza and the flimsiness of the cardboard exacerbates this likelihood. The result is that the consumer is left with a pizza in which a portion of it may be stuck to the underside of the lid, or lid segments, making the pizza unappealing.

To overcome the above-stated problem, it is customary in the art to use a plastic lid support known as a so-called "pizza saver". The purpose of the pizza saver is to prevent the lid of the pizza box from contacting the pizza when the lid is closed. An example of such a pizza saver is shown in FIG. 5 of the Ragan patent. Pizza saving devices generally have a flat top surface for engaging the underside of the pizza box lid, and legs extending from the top surface for contacting the pizza product.

Although the aforementioned pizza packages and pizza savers function satisfactorily for their intended purposes, there is a need for a novel device for both supporting the lid above the food product and for retaining the lid, or lid segments, of the receptacle in a closed position.

OBJECTS OF THE INVENTION

With the foregoing in mind, a primary object of the present invention is to provide a novel lid support and closure device for use with a receptacle to contain and transport a food product.

Another object of the present invention is to provide a unique lid support and closure device having the combined function of supporting a receptacle lid above a food product contained in the receptacle and of retaining the lid of the receptacle in a closed position.

A further object of the present invention is to provide for use in a pizza box having a plurality of lid segments, a device capable both of capturing the lid segments in a closed position and of preventing the underside of the lid segments from contacting a pizza contained in the box.

A still further object of the invention is to provide a lid support and closure device which is inexpensive to manufacture and is easy to install in a pizza box.

SUMMARY OF THE INVENTION

More specifically, the present invention provides a combination lid support and closure device for use with a pizza box used for transporting pizza. The pizza box has a bottom panel for supporting the pizza and a plurality of independent lid segments which cooperatively close the pizza box.

The combination lid support and closure device comprises a bottom stanchion portion which is engageable with the pizza contained within the pizza box. The bottom stanchion portion projects upwardly from the pizza to a remote end. An upper platen portion connects to the remote end and is engageable with an underside of at least one of the lid segments when the lid segments are in a closed position.

The combination lid support and closure device has a retention means connected to the upper platen portion for retaining the lid segments in a closed position.

One embodiment of the retention means includes a locking flange which is capable of extending through an aperture, or along an edge margin, of at least one of the lid segments. The locking flange is resiliently biased such that once the locking flange extends through the aperture, or over the edge margin, the locking flange assumes a position which prevents the lid segments from extending back over the locking flange.

BRIEF DESCRIPTION OF THE DRAWINGS

The foregoing and other objects, features, and advantages of the present invention should become apparent from the following description when taken in conjunction with the accompanying drawings, in which.

DETAILED DESCRIPTION OF THE PREFERRED EMBODIMENT

Figure 1:
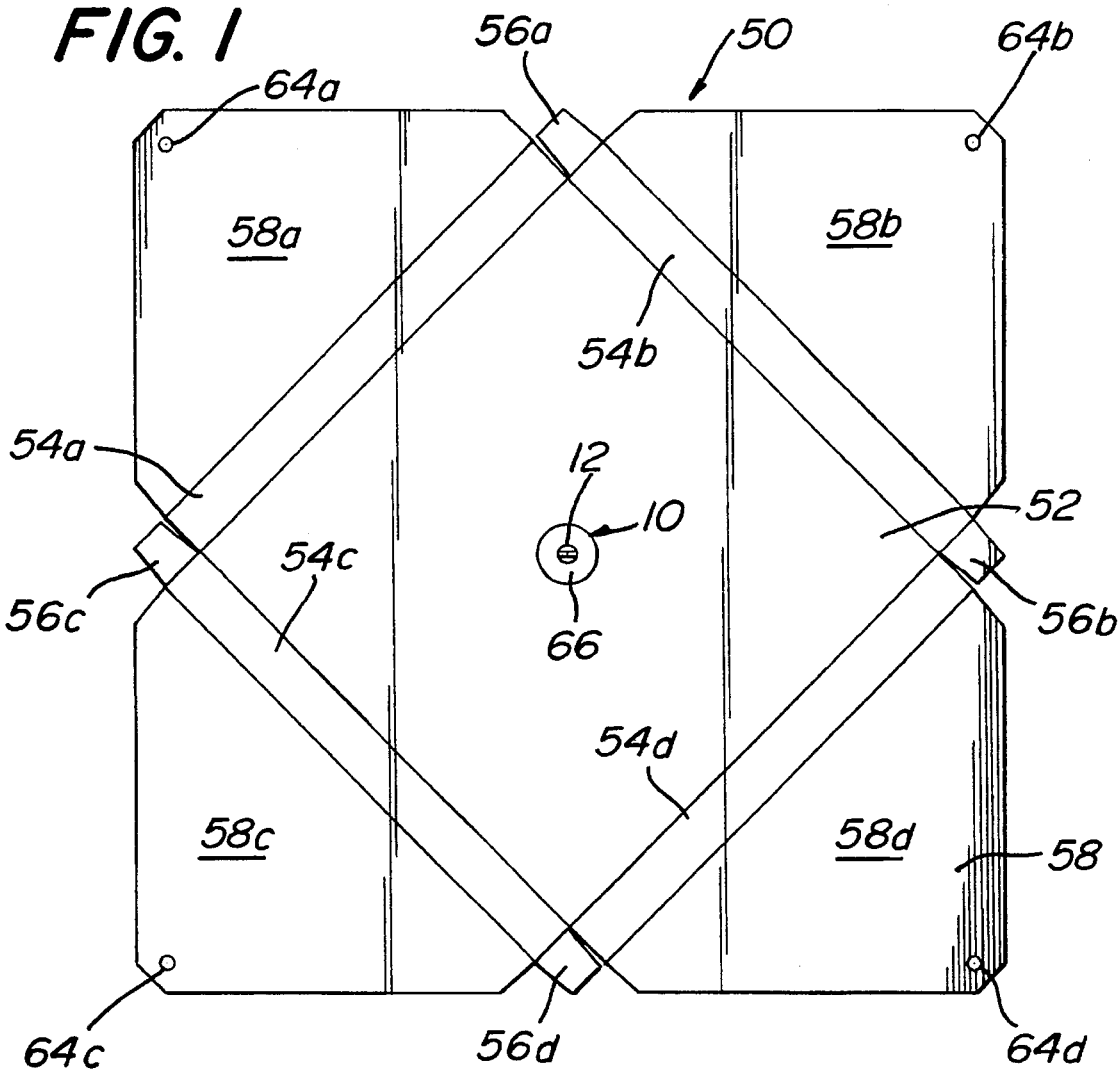
FIG. 1 is a plan view of a pizza carton in an unassembled condition with a lid support and closure device embodying the present invention centered thereon.

Referring now to the drawings, FIG. 1 illustrates a conventional unassembled pizza carton 50 with a combined lid support and closure device 10 centered thereon. The device 10 can be utilized with any closable container for containing and transporting a food product. While the examples discussed herein relate generally to receptacles for pizza, the device can be used with other food products, such as baked goods, including pies, cakes, and the like.

Receptacles for containing and transporting a pizza have various shapes and configurations. For example the pizza box 50 of FIGS. 1–5, has a bottom panel, or base, 52 for supporting a pizza 40 thereon. The box 50 has a peripheral sidewall 54 which encircles the pizza 40. The peripheral sidewall 54 shown in FIG. 1 has four separate sidewall sections 54*a*, 54*b*, 54*c*, and 54*d* with engageable side flaps 56*a*, 56*b*, 56*c*, and 56*d*. The pizza box 50 has at least one lid segment 58 for closing the box.

As shown in FIG. 1, four lid segments 58*a*, 58*b*, 58*c*, and 58*d* are utilized to close the box 50. Each lid segment 58*a*, 58*b*, 58*c*, and 58*d* is provided with an aperture 64*a*, 64*b*, 64*c* and 64*d*, respectively, which align together when the lid segments are disposed in a closed position illustrated in FIG. 4.

Figure 6:
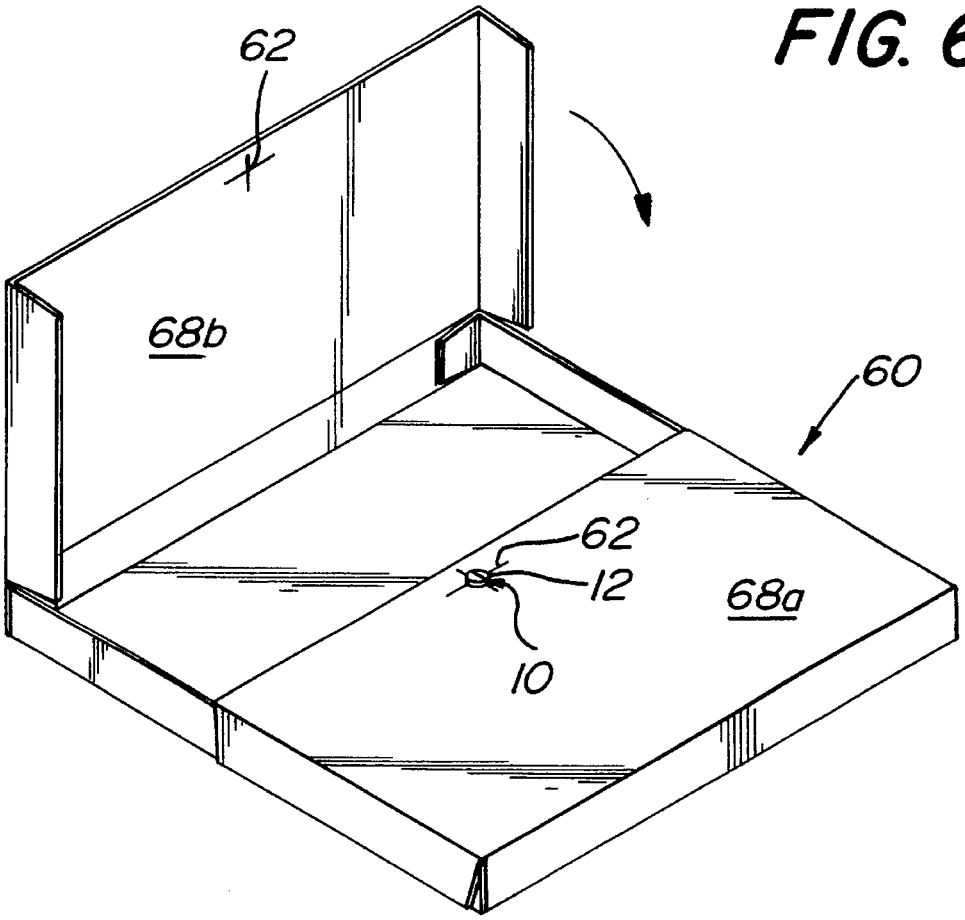
FIG. 6 is a perspective view of the lid support and closure device used with a pizza box having two lid segments.
Figure 7:
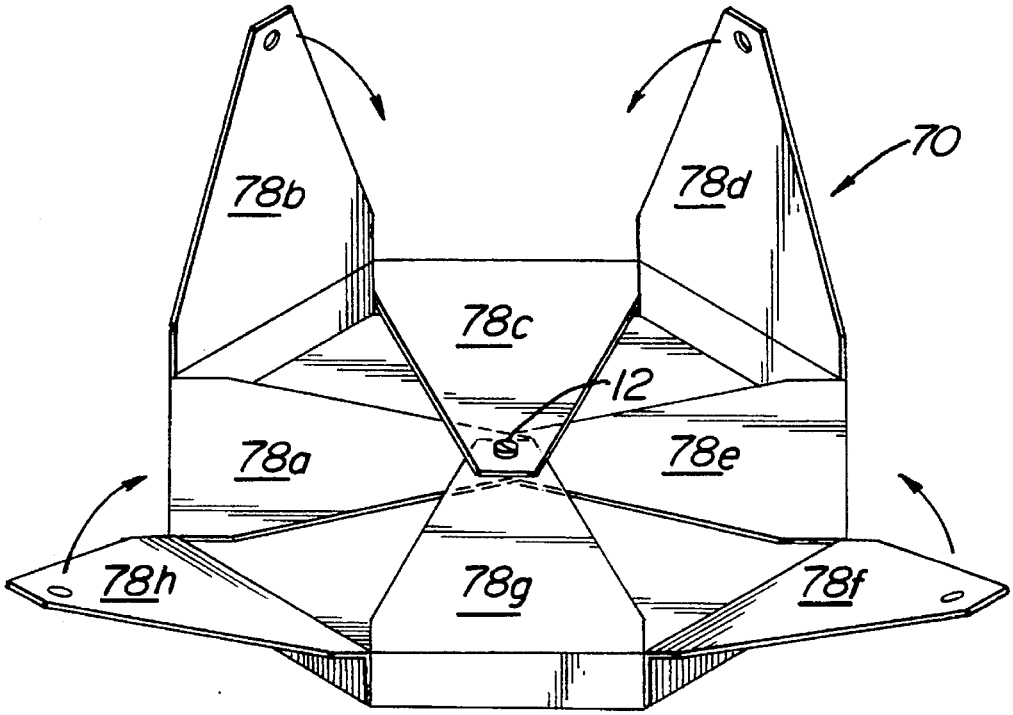
FIG. 7 is a perspective view of the lid support and closure device in use with a pizza box having eight lid segments.

The device 10 of the present invention can be used with other pizza box structures, for example, the boxes illustrated in FIGS. 6 and 7. The pizza box 60 of FIG. 6 has two lid segments 68*a* and 68*b*, while the pizza box 70 of FIG. 7 has eight lid segments 78*a*, 78*b*, 78*c*, 78*d*, 78*e*, 78*f*, 78*g* and 78*h*.

The multi-lid segment boxes are advantageous since they utilize less cardboard and provide less cardboard waste in their manufacture. For instance, the box shown in FIG. 1 can be manufactured from a square piece of cardboard enabling most of the cardboard preform to be utilized as part of the box with only a small portion being discarded as scrap.

The design of a pizza box having a plurality of lid segments normally includes some type of flap interlock configuration, such as slits, to releasably secure the lid segments in a closed position. The use of the flap slits requires the use of excess cardboard and increases cardboard waste.

The present invention eliminates the need for complicated flap interlock structures by providing a lid support and closure device 10 which has retention or locking means 12 for securing a plurality of lid segments in a closed position and a support means 66 for preventing the lid segments from bowing downwardly an excessive amount and contacting the pizza 40 contained in the box.

Figure 2:
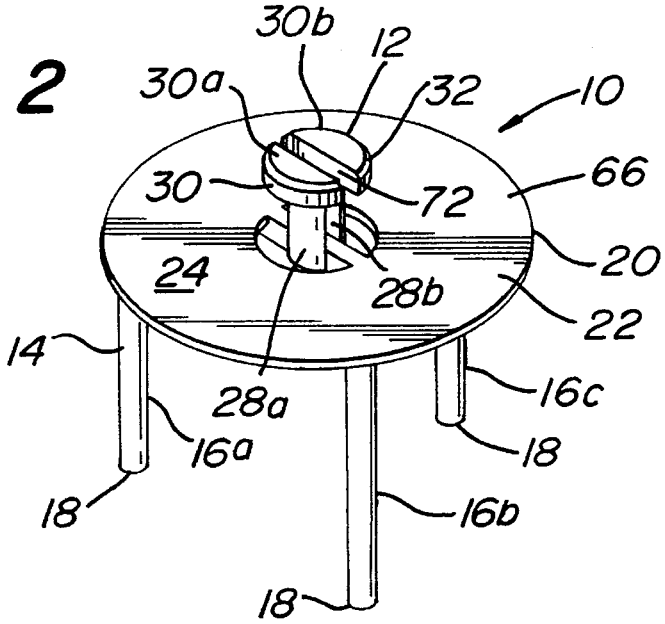
FIG. 2 is a perspective view of a lid support and closure device according to the present invention.
Figure 5:
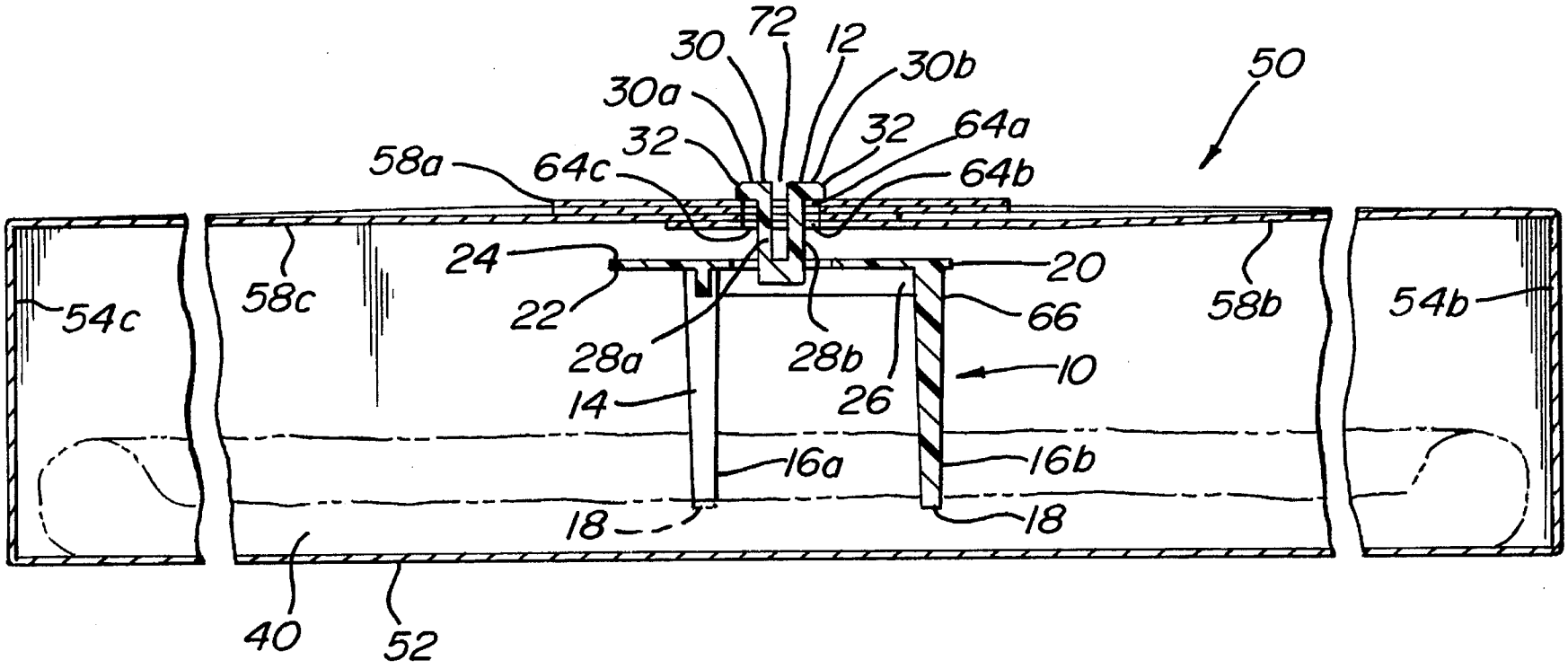
FIG. 5 is a cross-sectional view of FIG. 4 taken along line 5—5.

To this end, one preferred embodiment of the device 10 of the present invention is shown in FIG. 2. As best seen in FIG. 5, the support means 66 of the device 10 includes a bottom stanchion portion 14 having a lower end 18 which is engageable with the pizza 40 supported on the bottom box panel 52. As shown in FIGS. 2 and 5, the bottom stanchion portion 14 comprises three vertically extending legs 16*a*, 16*b*, and 16*c* of a height slightly less than the height of the side panels 54*b* and 54*c*.

The support means 66 has an upper portion 20 connected to the legs 16*a*, 16*b*, and 16*c* at the upper remote end of the legs 16*a*, 16*b*, 16*c*, opposite the pizza 40. As shown in FIG. 2, the upper portion 20 comprises a circular disc, or platen, 22 which is supported by the legs 16*a*, 16*b*, and 16*c*. The platen 22 has an upper surface 24 for operatively engaging the underside of the lid of the pizza box. As shown in FIG. 5, the connection between the legs 16*a*, 16*b*, and 16*c* and the platen 22 is preferably strengthened by the use of strengthening ribs 26.

Means 12 for releasably locking the pizza box lid in a closed position is connected to and extends from the upper portion 20 of the lid support and closure device 10. In the embodiment shown in FIG. 2, the locking, or retention, means 12 includes two stems 28*a* and 28*b* projecting upwardly from the platen 22 and terminating in a locking flange 30. The locking flange 30 comprises two semi-circular locking flange sections 30*a* and 30*b*, which extend parallel to the upper surface 24 of the platen 22. As illustrated in FIG. 5, three lid segments 58*a*, 58*b*, and 58*c* of the pizza box 50 are retained and captured between the locking flange sections 30*a* and 30*b* and the upper surface 24 of the platen 22 after the flange sections 30*a* and 30*b* are inserted through the apertures 64*a*, 64*b*, and 64*c* in the lid segments 58*a*, 58*b*, and 58*c*, respectively.

To facilitate insertion of the flange sections 30*a* and 30*b* through the lid apertures, the stems 28*a* and 28*b* project upwardly in spaced parallel relation and form a gap 72 extending diametrically between the semi-circular flange sections 30*a* and 30*b*. The stems 28*a* and 28*b* are rigidly connected at their bases to the platen 22, but are flexible inwardly toward one another to enable the flange sections 30*a* and 30*b* to be urged together to form a substantially circular structure capable of being displaced readily through the circular apertures 64*a*, 64*b*, 64*c*, and 64*d* in the box lid segments. Thus, the flange sections 30*a* and 30*b* are normally biased into a locking position, but are capable of being displaced into an unlocking insertion position.

Figure 3:
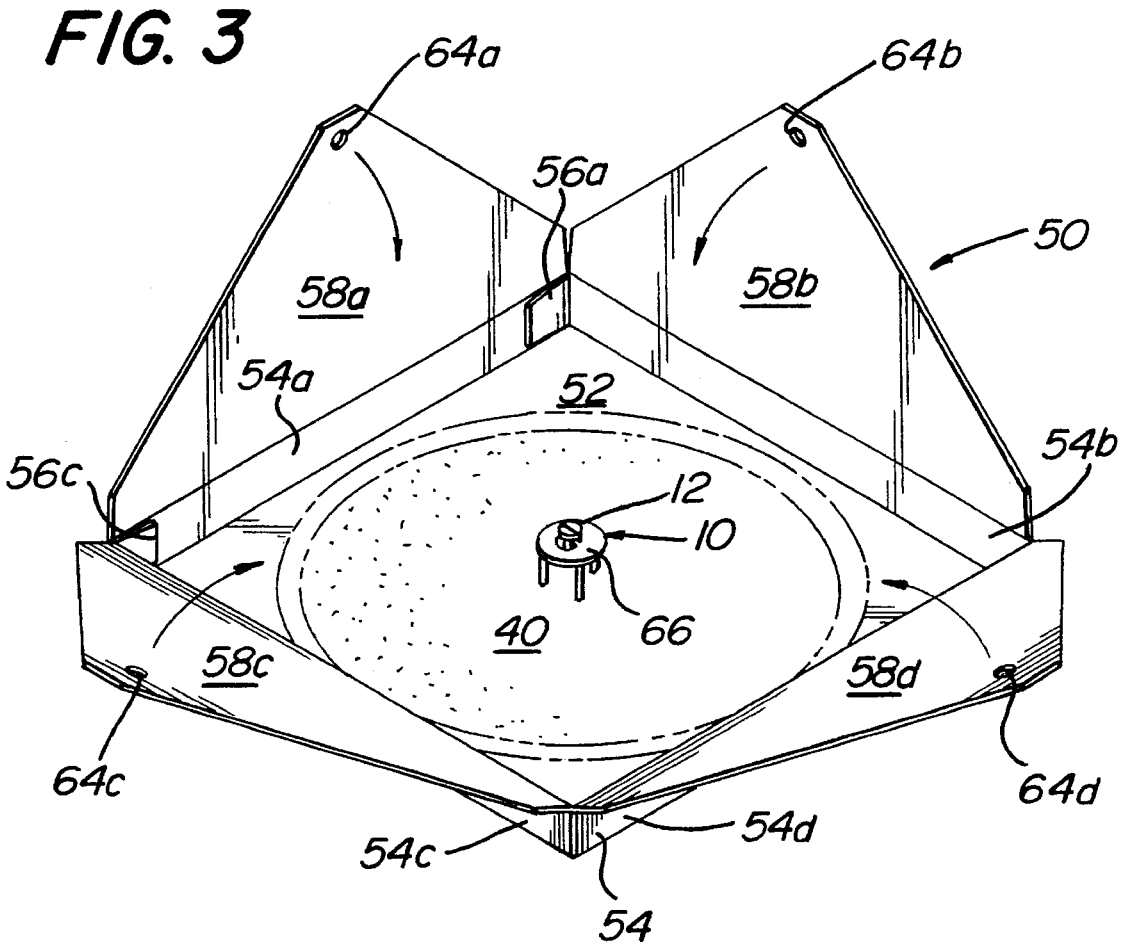
FIG. 3 is a perspective view of an assembled pizza box with a plurality of lid segments in an open position, the pizza box containing a pizza on which is located the lid support and closure device of the present invention.
Figure 4:
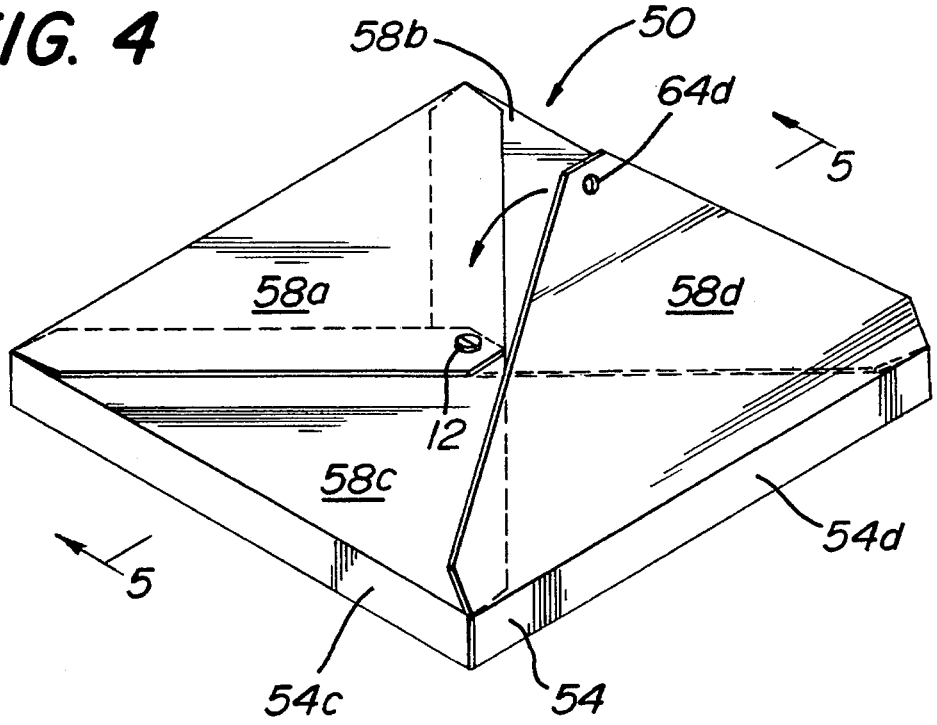
FIG. 4 is a perspective view of the pizza box illustrated in FIG. 3, with three of the lid segments in a closed position.

When in use, the device 10 of the present invention is centered centrally on top of the pizza 40 within the open pizza box 50 as shown in FIG. 3. Each lid segment 58*a*, 58*b*, 58*c*, and 58*d* one by one, or in unison, is then folded to a closed position and pressed firmly over the locking means 12. To facilitate insertion, the locking flange segments 30*a* and 30*b* have chamfered peripheral camming surfaces 32 enabling the pizza box lid segments 58*a*, 58*b*, 58*c*, and 58*d* to be pressed over the locking flange 30 for causing the locking flange sections 30*a* and 30*b* to automatically deflect inwardly toward one another to decrease the overall size of the locking flange 30 in plan and to allow it to fit through the apertures 64*a*, 64*b*, 64*c*, and 64*d* of the box lid segments. The locking means 12 is thereby biased into the insertion position by the lid segments as they are pressed over the locking means 12. The locking means 12 is resiliently biased into its locking position after the locking flange 30 extends through the apertures. The support means 66 engages the underside of the lid segments after they have been pressed downwardly over the locking means 12 to prevent the user from pressing the lid segments into the pizza. As shown, FIG. 4 and FIG. 5 illustrates the retention means 12 in its normal locking position for retaining the plurality of lid segments 58*a*, 58*b*, and 58*c*, in a closed position.

The spacing between the locking flange 30 and the upper surface 24 of the platen 22 must accommodate the combined thickness of the lid segments to be secured closed. The spacing should also allow for extra clearance so that the lid segments are more easily opened and closed. For instance, in FIG. 5, the spacing between locking flange 30 and the upper surface 24 accommodates the combined thickness of lid segments 58*a*, 58*b*, and 58*c*, while providing ample clearance for the thickness of lid segment 58*d* (not shown).

To open the pizza box 50, the locking flange sections 30*a* and 30*b* can be urged into the insertion position to allow the lid segments to extend over and past the locking flange 30. This may be accomplished by pulling upwardly with sufficient force on the lid segments to release the lid segments from the locking means 12, or by applying inward pressure to the two locking flange segments 30*a* and 30*b* so that they are pressed together to allow the lid segments to fold outwardly over the locking flange 30.

There are various modifications which can be made to the combination lid support and closure device 10 of the present invention or to the structure of the pizza box in which it is used. For instance, the retention means 12 does not have to extend through an aperture in the top lid, but could extend through a deflectable slit 62 in the lid, as shown in FIG. 6. Instead of an aperture or a deflectable slit, the retention means 12 could simply capture a portion of an edge margin of a lid. Alternatively, the device 10 can capture a single lid segment which overlaps with, and thereby captures, the remaining lid segments.

An alternate retention means 12 can have the locking flange connected to the stem by a hinge. The locking flange can be positioned vertically to extend through the aperture of the lid segment, and then horizontally to retain the box lid closed. In another alternative, the locking flange can be releasably coupled to the stem of the device after the lid segments are in a closed position.

The device of the present invention provides a combination lid support and closure for use with a pizza box which not only protects the pizza from being damaged, but provides a ready means for retaining closed the lid segments of a pizza box.

While preferred embodiments of the present invention have been described in detail, various modifications, alterations, and changes may be made without departing from the spirit and scope of the invention as defined in the appended claims.

We claim:

1. A combination lid support and closure device for use with a receptacle for containing and transporting a food product, the receptacle having at least one top panel moveable between an open position and a closed position and a bottom panel for supporting the food product, the device comprising:

support means positionable within the receptacle and having a top surface engageable with an underside of the at least one top panel for preventing the at least one top panel from contacting the food product located in the receptacle; and retention means connected to said support means for retaining the at least one top panel in the closed position;

wherein said retention means includes a locking flange spaced from said top surface of said support means for capturing therebetween a portion of the at least one top panel for retaining the at least one top panel in the closed positions; and wherein said support means includes a stanchion portion having an upper end providing said top surface and a lower end adapted to engage the food product on the bottom panel, so that said locking flange captures the at least one top panel when pressed downwardly into the closed position.

2. A combination lid support and closure device for use with a box adapted to contain and transport a food product, the box having a plurality of lid segments affording opening and closing of the box, at least one of the lid segments having an aperture, the device comprising:

support means positionable within the box for supporting the lid segments in a closed position a spaced distance from the food product when placed in the box, the support means having a top surface operatively engageable with an underside of at least one of the lid segments; and retention means extending from said support means for retaining the lid segments in said closed position, the retention means including a locking flange capable of capturing the at least one lid segment in the closed position;

wherein said retention means includes a resilient means for disposing said locking flange in a locking position to prevent said locking flange from fitting through the aperture, and capable of movably disposing said locking flange into an insertion position to allow said locking flange to fit through the aperture of the at least one lid segment, whereby the at least one lid segment is capable of being captured automatically between said top surface of said support means and said locking flange when said at least one panel is disposed in the closed position.

3. A device according to claim 2, wherein said locking flange is spaced from said top surface a distance at least as great as the thickness of one of said lid segments.

4. A device according to claim 3, wherein said locking flange comprises a plurality of flange sections sized to pass through the aperture when in said insertion position.

5. A device according to claim 4, wherein said resilient means comprises a plurality of stems projecting upwardly from said support means in a direction transverse to said top surface, each stem having one of said flange sections extending laterally therefrom.

6. A device according to claim 5, wherein said plurality of flange sections are spaced apart by a gap such that said insertion position is achieved when said plurality of flange sections are urged toward one another to close said gap.

7. A combination lid support and closure device for use with a pizza box for transporting a pizza, the pizza box having a plurality of independently moveable lid segments for cooperatively closing the pizza box, at least one of the lid segments having an aperture extending therethrough, the device comprising:

a bottom stanchion portion engageable with a pizza contained within the pizza box and extending upwardly therefrom to a remote end;

an upper platen portion connected to said remote end and capable of engaging an underside of at least one of the lid segments when the pizza box lid segments are closed; and locking means connected to said upper platen portion for releasably retaining at least one lid segment between said locking means and said upper platen portion adjacent said aperture;

wherein said locking means includes a locking flange extending in spaced parallel relation with said upper platen portion; and wherein said locking means includes a resiliently flexible stem portion projecting upwardly from said upper platen portion and mounting said locking flange, said resiliently flexible stem portion capable of providing lateral deflection to said locking flange from an insertion position for permitting said locking flange to extend through the aperture, to a locking position for preventing said locking flange from extending through the aperture.

8. A combination lid support and closure device for use with a pizza box for transporting a pizza, the pizza box having a plurality of independently moveable lid segments for cooperatively closing the pizza box, at least one of the lid segments having an aperture extending therethrough, the device comprising:

a bottom stanchion portion engageable with a pizza contained within the pizza box and extending Upwardly therefrom to a remote end;

an upper platen portion connected to said remote end and capable of engaging an underside of at least one of the lid segments when the pizza box lid segments are closed; and locking means connected to said upper platen portion for releasably retaining at least one lid segment between said locking means and said upper platen portion adjacent said aperture;

wherein said locking means includes a locking flange extending in spaced parallel relation with said upper platen portion; and wherein said locking means comprises a plurality of independent locking flange sections, said flange sections integrally connected to said upper platen portion by a plurality of stems, each said stem extending between one of said flange sections and said upper platen portion.

9. A device according to claim 8, wherein said flange sections are normally spaced laterally from one another and are urged toward one another for insertion through said lid aperture.

10. A device according to claim 9, wherein said stems resiliently bias said flange sections into said laterally spaced relation.

11. A device according to claim 10, wherein said locking means has two of said flange sections and two of said stems projecting upwardly from said platen.

12. For use with a pizza box having a bottom panel, side panels, and a plurality of top lid panels moveable from an open position to a closure position, the top lid panels having overlapping edge margins centrally of the bottom panel, means for automatically locking the top lid panels in the closure position and for preventing the top lid panels from bowing downwardly toward the bottom panel into contact with pizza thereon after the top lid panels are disposed in the closure position, said means having a stanchion portion for projecting upwardly from the bottom panel, surface means on said stanchion portion for engaging and supporting said top lid panels when overlapped in said closure position, and locking means on said stanchion portion cooperable with at least one of the top lid panels for automatically locking the top lid panels in the closure position when the top lid panels are urged downwardly against said surface means on said stanchion portion, wherein said locking means includes a locking flange on said stanchion portion above said surface means, wherein an edge margin on the at least one of the top lid panels is engageable between said locking flange and said surface means when the top lid panels are in the closure position, and wherein the at least one of the top lid panels is planar and has a resiliently deflectable edge margin engageable between said locking flange and said surface means on said stanchion portion.

13. For use with a pizza box having a bottom panel, side panels, and a plurality of top lid panels moveable from an open position to a closure position, the top lid panels having overlapping edge margins centrally of the bottom panel, means for automatically locking the top lid panels in the closure position and for preventing the top lid panels from bowing downwardly toward the bottom panel into contact with pizza thereon after the top lid panels are disposed in the closure position, said means having a stanchion portion for projecting upwardly from the bottom panel, surface means on said stanchion portion for engaging and supporting said top lid panels when overlapped in said closure position, and locking means on said stanchion portion cooperable with at least one of the top lid panels for automatically locking the top lid panels in the closure position when the top lid panels are urged downwardly against said surface means on said stanchion portion, wherein said locking means includes a locking flange on said stanchion portion above said surface means, wherein an edge margin on the at least one of the top lid panels is engageable between said locking flange and said surface means when the top lid panels are in the closure position, wherein the at least one of the top lid panels is planar and has an aperture, wherein said locking means has stem means resiliently connecting said locking flange to said stanchion portion for enabling said locking flange to be resiliently biased between insertion and locking positions, and wherein in said insertion position said locking flange passes through the aperture and in said locking position said locking flange engages the at least one of the top lid panels adjacent the aperture.

* * * * *